US010146162B2

(12) United States Patent
Tanaka

(10) Patent No.: US 10,146,162 B2
(45) Date of Patent: Dec. 4, 2018

(54) IMAGE FORMING APPARATUS

(71) Applicant: CANON KABUSHIKI KAISHA, Tokyo (JP)

(72) Inventor: Sumito Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/360,782

(22) Filed: Nov. 23, 2016

(65) Prior Publication Data

US 2017/0153586 A1 Jun. 1, 2017

(30) Foreign Application Priority Data

Nov. 30, 2015 (WO) ..... PCT/JP2015/083530

(51) Int. Cl.
*G03G 15/00* (2006.01)

(52) U.S. Cl.
CPC ..... *G03G 15/50* (2013.01)

(58) Field of Classification Search
CPC ..... G03G 15/50
See application file for complete search history.

(56) References Cited

U.S. PATENT DOCUMENTS 7,650,093 B2 * 1/2010 Suzuki ..... H04N 1/00015 399/301

FOREIGN PATENT DOCUMENTS

| | | | |
|---|---|---|---|
| JP | H07140738 | A | 6/1995 |
| JP | 2001188389 | A | 7/2001 |
| JP | 2004163496 | A | 6/2004 |
| JP | 2005172997 | A | 6/2005 |
| JP | 2006189795 | A | 7/2006 |
| JP | 2007296819 | A | 11/2007 |
| JP | 2009151286 | A | 7/2009 |
| JP | 2009285914 | A | 12/2009 |
| JP | 2011133771 | A | 7/2011 |
| JP | 2011145350 | A | 7/2011 |
| JP | 2012150233 | A | 8/2012 |
| KR | 20080103782 | A | 11/2008 |

* cited by examiner

*Primary Examiner* — David M Gray
*Assistant Examiner* — Michael Harrison
(74) *Attorney, Agent, or Firm* — Canon U.S.A., Inc. IP Division

(57) ABSTRACT

Two types of correction data, first correction data and second correction data, are used to correct density on the basis of reading results obtained by a reading unit reading a test image formed on a sheet. The first correction data is data for correcting image density in the rotation axis direction of the photoconductor. The correction using the first correction data is performed in each of multiple areas on the photoconductor which correspond to an area in which a toner image of the test image is formed. The second correction data is data for correcting image density in the rotation axis direction of the photoconductor. The correction using the second correction data is performed in areas outside the area in which the toner image of the test image which is read by the reading unit is formed.

13 Claims, 10 Drawing Sheets

| ADDRESS i | -6 | -5 | -4 | -3 | -2 | -1 | 0 | +1 | +2 | +3 | +4 | +5 | +6 |
|---|---|---|---|---|---|---|---|---|---|---|---|---|---|
| DENSITY Di | 0.21 | 0.22 | 0.24 | 0.26 | 0.27 | 0.27 | 0.28 | 0.3 | 0.32 | 0.31 | 0.29 | 0.28 | 0.26 |
| CORRECTION VALUE Pi | 6 | 5 | 3 | 1 | -0 | 0 | -1 | -3 | -5 | -4 | -2 | -1 | 1 |

| ADDRESS i | -6 | -5 | -4 | -3 | -2 | -1 | 0 | +1 | +2 | +3 | +4 | +5 | +6 |
|---|---|---|---|---|---|---|---|---|---|---|---|---|---|
| DENSITY Di | - | 0.22 | 0.24 | 0.26 | 0.27 | 0.27 | 0.28 | 0.3 | 0.32 | 0.31 | 0.29 | 0.28 | - |
| CORRECTION VALUE Pi | 5 | 5 | 3 | 1 | -0 | 0 | -1 | -3 | -5 | -4 | -2 | -1 | -1 |

FIG. 10

| Position in main scanning direction | Y | M | C | Bk |
|---|---|---|---|---|
| +6 | 1 | 0 | 1 | 1 |
| +5 | −1 | −1 | −1 | −1 |
| +4 | −2 | −2 | −2 | −2 |
| +3 | −4 | −4 | −3 | −1 |
| +2 | −5 | −4 | −2 | −3 |
| +1 | −3 | −3 | −3 | −2 |
| 0 | −1 | −2 | −1 | −1 |
| −1 | 0 | 0 | 0 | 0 |
| −2 | 0 | 1 | 0 | 0 |
| −3 | 1 | 1 | 1 | 1 |
| −4 | 3 | 2 | 2 | 2 |
| −5 | 5 | 3 | 1 | 3 |
| −6 | 6 | 4 | 2 | 2 |

Finish

IMAGE FORMING APPARATUS

TECHNICAL FIELD

The present invention relates to an electrophotographic image forming apparatus, such as a multifunction device or a copier which includes a reading device.

BACKGROUND ART

An electrophotographic image forming apparatus forms an electrostatic latent image in such a manner that, after a rotating photoconductor is uniformly charged by using a charger, the surface of the photoconductor is exposed to light in accordance with image data. The image forming apparatus develops the electrostatic latent image by using toner, and transfers, onto a sheet, the toner image obtained through development, and fixes the toner image. The image forming apparatus employs a configuration in which such an image formation process is used to print a desired image.

In an electrophotographic system, non-uniformity in density of a toner image formed on a sheet may occur in the rotation axis direction of a photoconductor. This non-uniformity occurs due to variations in the light amount with which an electrostatic latent image is formed on the photoconductor or variations in light sensitivity of the photoconductor surface.

To suppress such density non-uniformity in the rotation axis direction of a photoconductor, the following configuration has been proposed in the patent literature. Multiple test patterns are printed in the rotation axis direction of a photoconductor on a sheet. The sheet on which the test patterns are printed is fed again, and the test patterns are read by using a density sensor disposed on a paper conveying path. The laser beam amount is adjusted at each of the positions in the main scanning direction on the basis of the read density.

Japanese Patent Laid-Open No. 2011-133771 describes such a process.

When a test image is formed on a sheet with a size smaller than that of a photoconductor in the rotation axis direction of the photoconductor, density is not corrected in areas outside the range in which the test image is formed.

Therefore, there is a need for an image forming apparatus which corrects density in areas outside the range in which a test image is formed.

SUMMARY

An image forming apparatus according to the exemplary embodiments aims to satisfy the above-described need and includes a photoconductor that rotates, an exposure unit, a developing unit, a transfer unit, a reading unit, and a data generating unit. The exposure unit exposes the photoconductor to light and forms an electrostatic latent image on the photoconductor. The developing unit develops the electrostatic latent image by using toner. The electrostatic latent image is formed on the photoconductor. The transfer unit transfers a toner image onto a sheet. The toner image is obtained by the developing unit performing development onto a surface of the photoconductor. The reading unit reads a document image. The data generating unit generates first correction data and second correction data on the basis of a reading result. The reading result is obtained by the reading unit reading a test image formed on a sheet. The first correction data is data for a first correction of image density in a rotation axis direction of the photoconductor. The first correction is performed in each of a plurality of areas of the photoconductor. The plurality of areas correspond to an area in which the toner image of the test image is formed. The second correction data is data for a second correction of image density in the rotation axis direction of the photoconductor. The second correction is performed in an outside area outside the area in which the toner image of the test image is formed.

Further features will become apparent from the following description of exemplary embodiments with reference to the attached drawings.

BRIEF DESCRIPTION OF THE DRAWINGS

FIG. 10 is a diagram illustrating a manual input screen for correction values according to one embodiment.

DESCRIPTION OF THE EMBODIMENTS

Schematic Configuration of the Entire Image Forming Apparatus

Figure 1A:
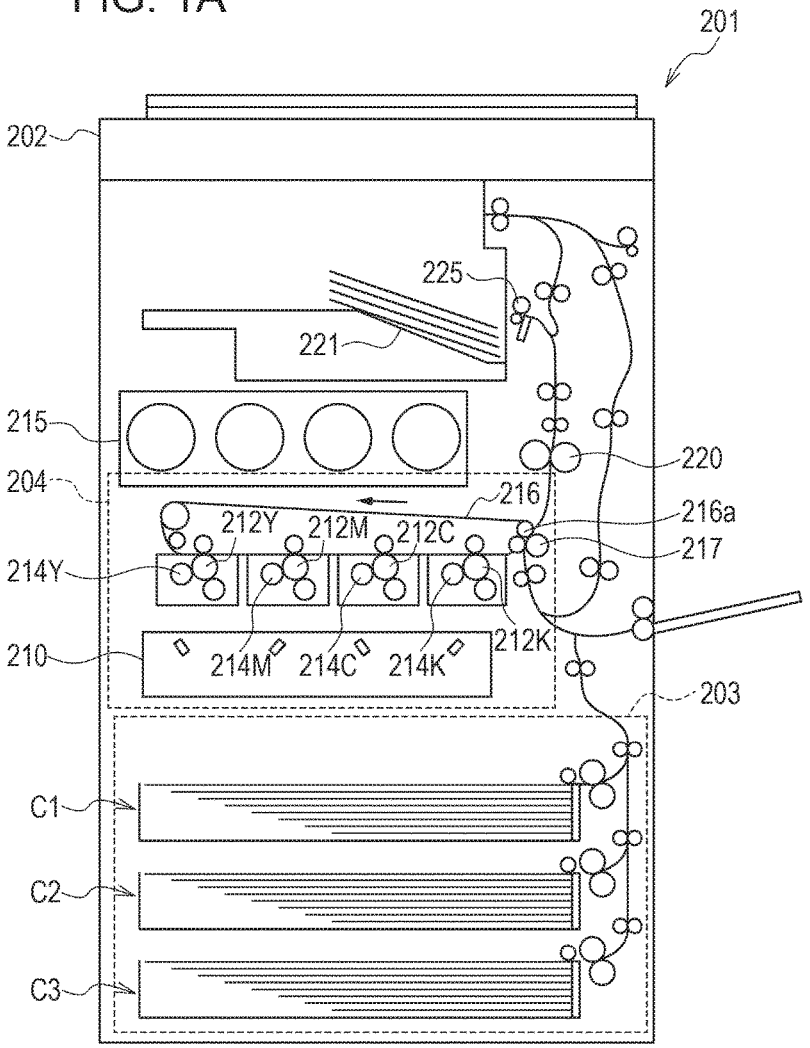
FIGS. 1A and 1B are a schematic sectional view and a control block diagram of the entire image forming apparatus according to one embodiment.
Figure 1B:
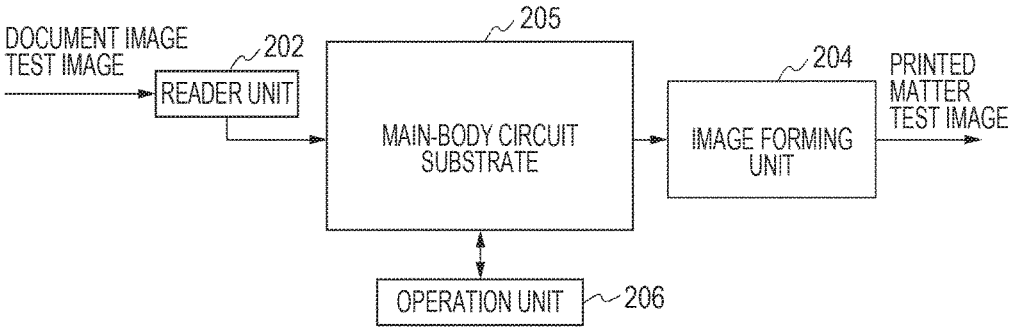

FIGS. 1A and 1B provide a schematic sectional view of a copier 201 which is an image forming apparatus according to one embodiment. The copier 201 schematically includes a reader unit 202 which is a reading unit for a document image, an image forming unit 204 which forms toner images and transfers the images onto a sheet, and a paper feeding unit 203 which feeds and conveys a sheet to the image forming unit. The image forming unit 204 includes photoconductor drums 212Y, 212M, 212C, and 212Bk which are photoconductors for colors, yellow (Y), magenta (M), cyan (C), and black (Bk), and developing units 214Y, 214M, 214C, and 214Bk. Since the configurations for the colors which are used to form toner images are similar to one another, Y, M, C, and Bk which represent colors are hereinafter not used. An exposure unit 210 which exposes the photoconductor drums 212 to light in accordance with image data is disposed below the photoconductor drums 212. The exposure unit 210 employs a configuration described below to expose the surface of each of the photoconductor drums 212 to light in accordance with image data which is input from a main-body circuit substrate 205 and form an electrostatic latent image. The electrostatic latent image formed on the surface of the photoconductor drum 212 is developed by a corresponding one of the developing units 214 so that a toner image is formed on the surface of the photoconductor drum 212. After the toner image is temporarily held on an image bearing belt 216, the toner image is secondarily transferred to a sheet by a transfer unit including a transfer roller 216*a* and a transfer roller 217. A density detecting sensor 77 (see FIG. 3) which detects the density of the toner image held on the image bearing belt 216 is disposed near the transfer unit.

The paper feeding unit 203 feeds sheets stored in paper cassettes C1 to C3, to the transfer unit. The paper cassettes C1 to C3 have a configuration in which sheets of various sizes (such as A4, LTR, A3, and B4) may be stored. After the toner image is transferred onto a sheet by the transfer unit, the sheet is conveyed to a fixing device 220. The sheet on which the fixing device 220 has fixed the toner image is discharged via a discharge roller 225 onto a paper output tray 221.

Configuration of Reader Unit

The reader unit 202 which is attached in an upper portion of the copier includes a white LED and a CMOS sensor having an RGB filter. When the reader unit starts a reading operation, the white LED emits light on a document, and the CMOS sensor receives the light reflected from the document. The CMOS sensor obtains density information for each color on the basis of the light reflected from the document. The density information for each color is transferred to a control unit 205*a* (see FIG. 3) provided for the main-body circuit substrate 205. The control unit 205*a* converts the density information for each color into image data for printing. The image data for printing is input to the exposure unit described next.

Configuration of Exposure Unit

The exposure unit 210 exposes the surfaces of the photoconductor drums 212 to light on the basis of the image data which is input from the controller. In the present embodiment, an optical scanning apparatus using a semiconductor laser as a light source will be described as an example.

Figure 2A:
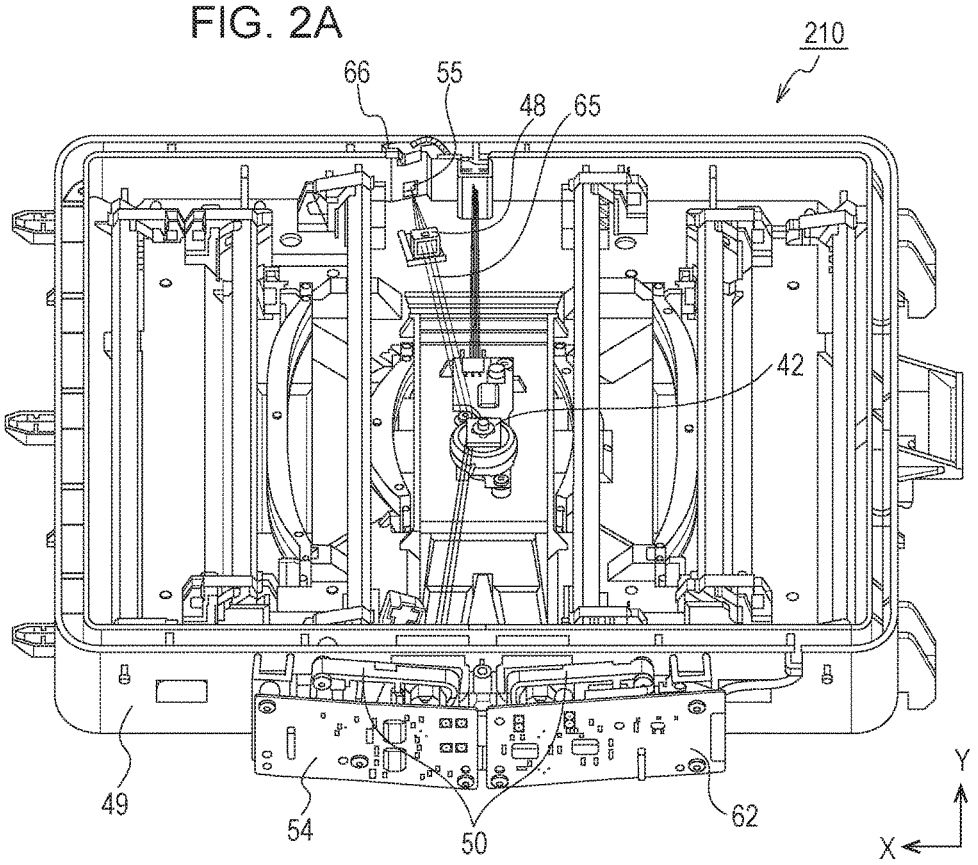
FIGS. 2A and 2B are a perspective view of an optical scanning apparatus which is an exposure unit and a sectional view illustrating the positional relationship between the optical scanning apparatus and photoconductor drums according to one embodiment.
Figure 2B:
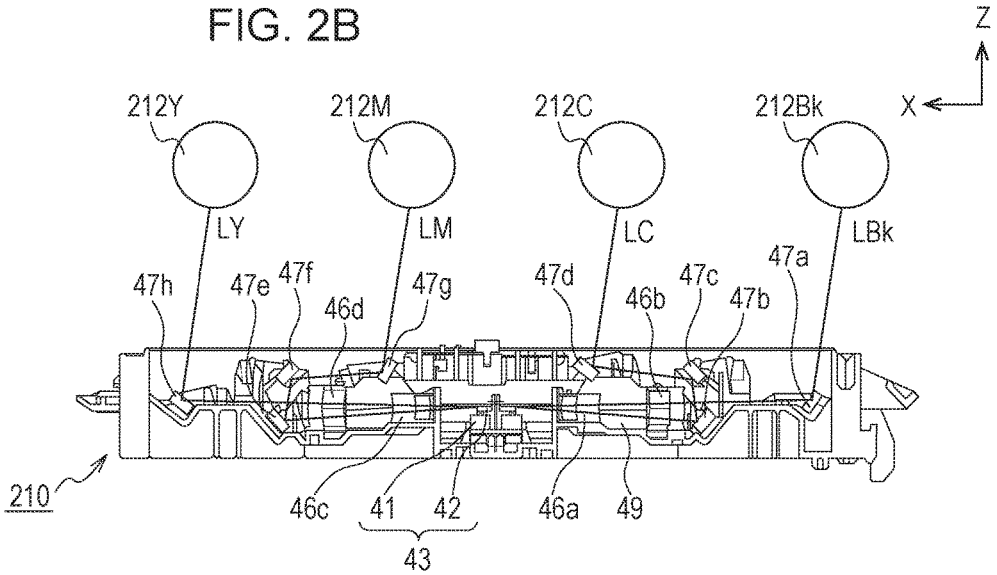
Figure 3:
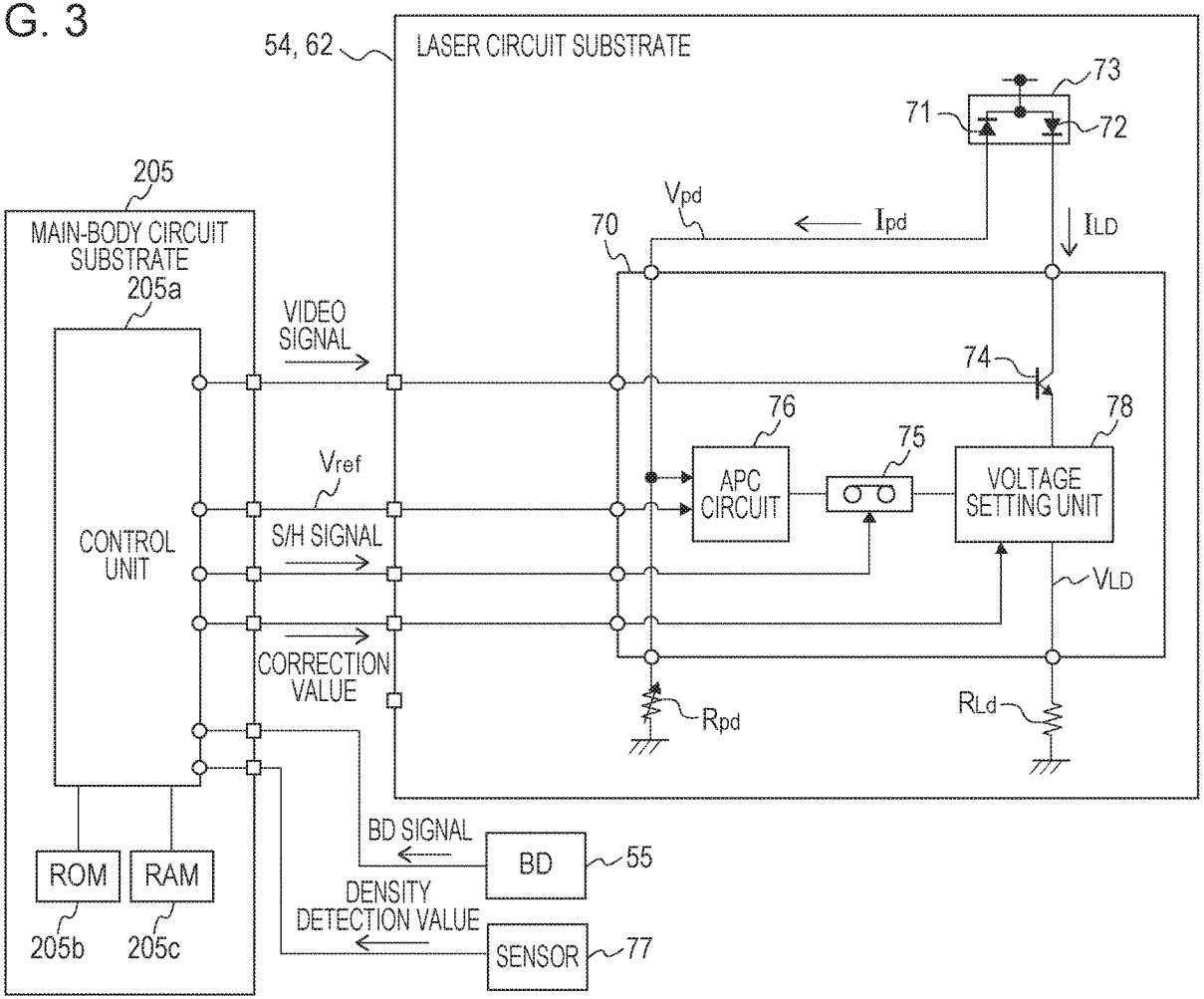
FIG. 3 is a diagram illustrating the control relationship among a main-body circuit substrate, a laser circuit substrate, a BD, and a sensor, according to one embodiment.

FIG. 2A is a perspective view illustrating the entire image of the optical scanning apparatus 210 which is the exposure unit. FIG. 2B is a sectional view illustrating the positional relationship between the optical scanning apparatus 210 and the photoconductor drums 212. FIG. 3 is a diagram illustrating the control relationship between the main-body circuit substrate 205 and a laser circuit substrate 54 or 62 provided for the optical scanning apparatus 210. The laser circuit substrate 54 is a substrate for yellow and magenta. The circuit for magenta is similar to that for yellow. Therefore, in FIG. 3, only the circuit for yellow is illustrated, and the circuit for magenta is not illustrated. Similarly, the laser circuit substrate 62 is a substrate for cyan and black, and is not illustrated.

As illustrated in FIG. 2A, the laser circuit substrates 54 and 64 are attached to the optical scanning apparatus 210. Each of the laser circuit substrates 54 and 62 includes a semiconductor laser 73 illustrated in FIG. 3. The semiconductor laser 73 includes a light-emitting unit (LD) 72, and the LD 72 emits a laser beam in accordance with the image data which is input from the main-body circuit substrate 205.

Returning back to FIG. 2B, description will be continued. A rotatable polygon mirror 42 which is a deflector, fθ lenses 46*a* to 46*d*, and reflecting mirrors 47*a* to 47*h* are disposed in the optical scanning apparatus 210. A light beam LBk emitted from the LD 72 is deflected by the rotatable polygon mirror 42 and enters a BD (Beam Detector) 55 and the fθ lens 46*d*. The function of the BD 55 will be described below. After the light beam LBk passing through the fθ lens 46*d* has passed through the fθ lens 46*d*, the light beam LBk is reflected by the reflecting mirror 47*h*. The light beam LBk reflected by the reflecting mirror 47*h* scans the photoconductor drum 212Bk. Similarly, a light beam LY, LM, or LC is guided to the surface of the photoconductor drum 212 for the corresponding color. Hereinafter, the direction in which a photoconductor drum is scanned (the same direction as the rotation axis direction of the photoconductor drum) is referred to as the main scanning direction.

Control of the emission timing and the light amount of a laser will be described. As illustrated in FIG. 3, the semiconductor laser 73 includes the light-emitting unit (LD) 72 and a photodiode (PD) 71. To light the LD 72, the control unit 205*a* inputs a video signal to a bipolar transistor (TR) 74. The video signal is a signal having two values of High/Low. While the video signal which is input to the TR 74 is High, a current ILD passes through the LD 72. Therefore, the LD 72 is lit. When the LD 72 is lit, part of a laser beam is received by the PD 71. The PD 71 outputs a current Ipd according to the amount of received light. An APC circuit 76 receives a potential Vpd determined by using Ipd and a resistance Rpd. In addition to the potential Vpd, the APC circuit 76 receives a reference potential Vref which is output from the control unit 205*a*. The reference potential Vref is determined on the basis of the toner density on the image bearing belt 216 which is read by the sensor 77. The APC circuit 76 compares Vpd with Vref. Only when a switch 75 is ON, the comparison result is input to a voltage setting unit 78. The switch 75 switches between ON and OFF on the basis of a sample-hold signal (S/H signal) which is output from the control unit 205*a*. When the switch 75 is ON, the voltage setting unit 78 adjusts a voltage VLD so that the comparison result is decreased. The current ILD passing through the LD 72 is determined on the basis of the relationship between the voltage VLD and a resistance RLD. That is, by adjusting the voltage VLD, the voltage setting unit 78 adjusts the current ILD passing through the LD 72. As described above, adjustment of the current ILD which is performed while the S/H signal is ON is called APC (Auto Power Control). In contrast, when the S/H signal is OFF, the switch 75 is turned OFF, and the result of comparison between Vpd and Vref is not input to the voltage setting unit 78. Therefore, APC is not performed.

Figure 4:
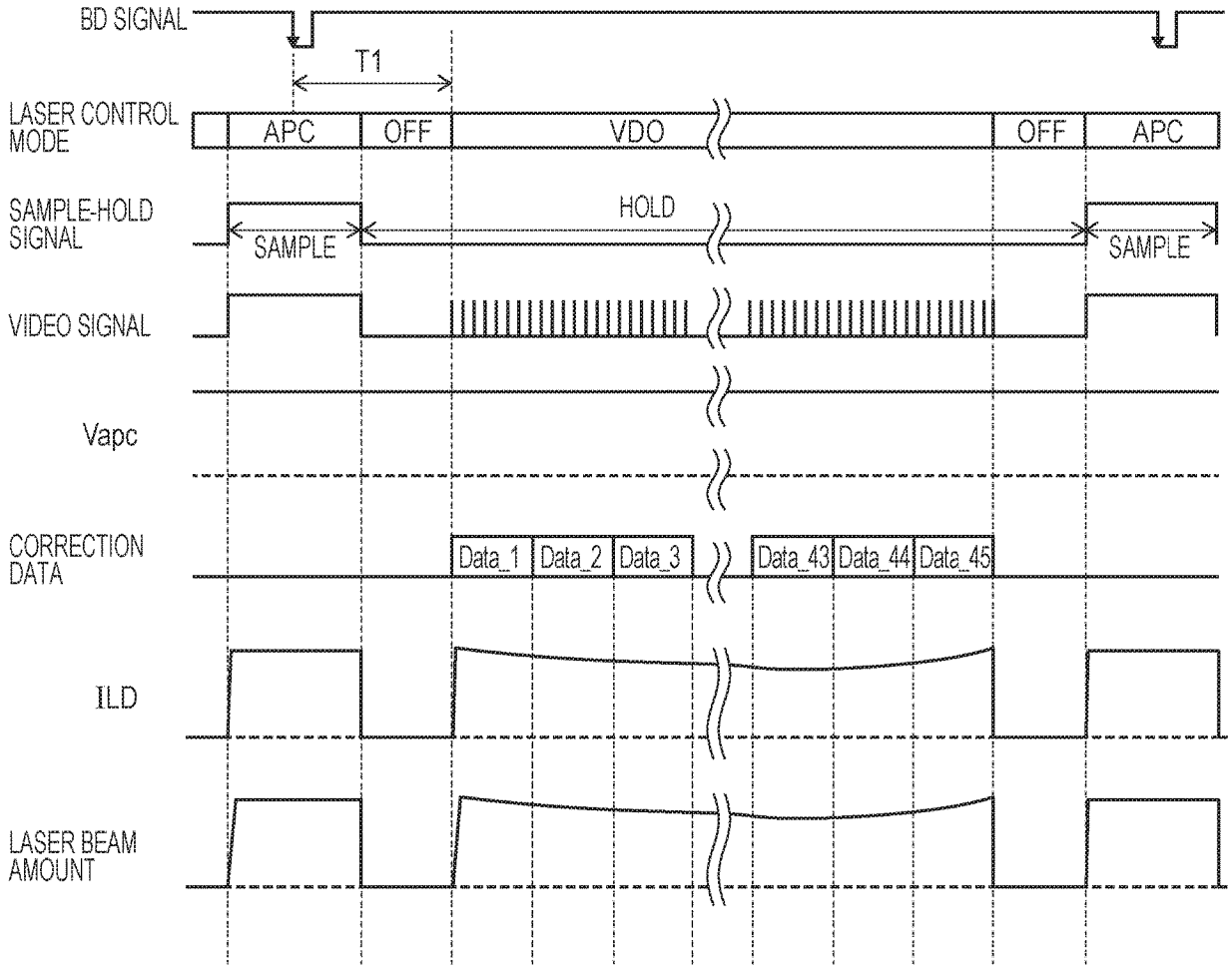
FIG. 4 is a timing chart for describing control of the emission timing and the light amount of a laser according to one embodiment.

FIG. 4 is a timing chart illustrating emission timing of a semiconductor laser and timings of various signals during a period (one scanning period) in which one scanning operation is performed on the surface of a photoconductor drum 212 by using a light beam. When the BD 55 which is a photosensor receives a laser beam (see FIG. 2A), the BD 55 outputs a BD signal which is a pulse signal. As illustrated in FIG. 4, the control unit 205*a* turns OFF the video signal after APC, and outputs the video signal again after a predetermined time T1 has elapsed from input of the BD signal. Keeping T1 constant enables the position (writing position) at which an electrostatic latent image is formed on the surface of the photoconductor drum 212 in every scanning period to be kept constant.

In the present embodiment, the writing position is adjusted in accordance with the position of a sheet stored in a paper cassette. The reason and the method of adjusting the writing position will be described.

As described above, the copier feeds a sheet from one of the paper cassettes C1 to C3 to the secondary transfer unit. The sheet which has reached the secondary transfer unit may be misregistered in the main scanning direction relative to the image. Misregistration of the sheet in the main scanning direction relative to the image causes the image transferred onto the sheet to be misregistered relative to the desired position. For example, this misregistration affects the size of a margin of the image formed on the sheet.

The reason for variations in position of a sheet in the main scanning direction is, for example, variations in registration of each paper cassette for the main body frame of the copier and/or variations in size of a part included in the paper cassette. Therefore, the amount of misregistration differs depending on a paper cassette. That is, the position of an image formed on a sheet differs depending on which paper cassette is used to feed the sheet, causing user complaint.

Therefore, in the present embodiment, how much a sheet reaching the secondary transfer unit is misregistered in the main scanning direction is measured in advance for each paper cassette. The time T1 illustrated in FIG. 4 is adjusted on the basis of the result of measurement of the misregistration amount of each paper cassette. By setting the adjustment amount of the time T1 for each paper cassette, a sheet fed from any paper cassette may be registered relative to the image in the main scanning direction. The control unit 205*a* has a module for adjusting the time T1 for each paper cassette, inside the control unit 205*a*. The control unit 205*a* corresponds to an adjusting unit for adjusting the writing position.

In the present embodiment, the method described above is used to adjust the writing position in the main scanning direction depending on which paper cassette is used to feed a sheet. When a test image for correcting density non-uniformity in the main scanning direction is to be printed, adjustment of the writing position for each paper cassette is not performed. The reason will be described below.

In the present embodiment, a semiconductor laser is used as a light source for exposing a photoconductor drum to light. However, this is not limiting. For example, an LED array in which multiple LED chips are arranged in the rotation axis direction of a photoconductor drum may be used to expose a photoconductor drum to light. When an LED array is used, one of the LED chips is aligned with an end of the image which is located in the rotation axis direction of a photoconductor drum, whereby the position of an image and the position of a sheet are adjusted.

Method of Correcting Density Non-Uniformity in the Main Scanning Direction

Figure 5:
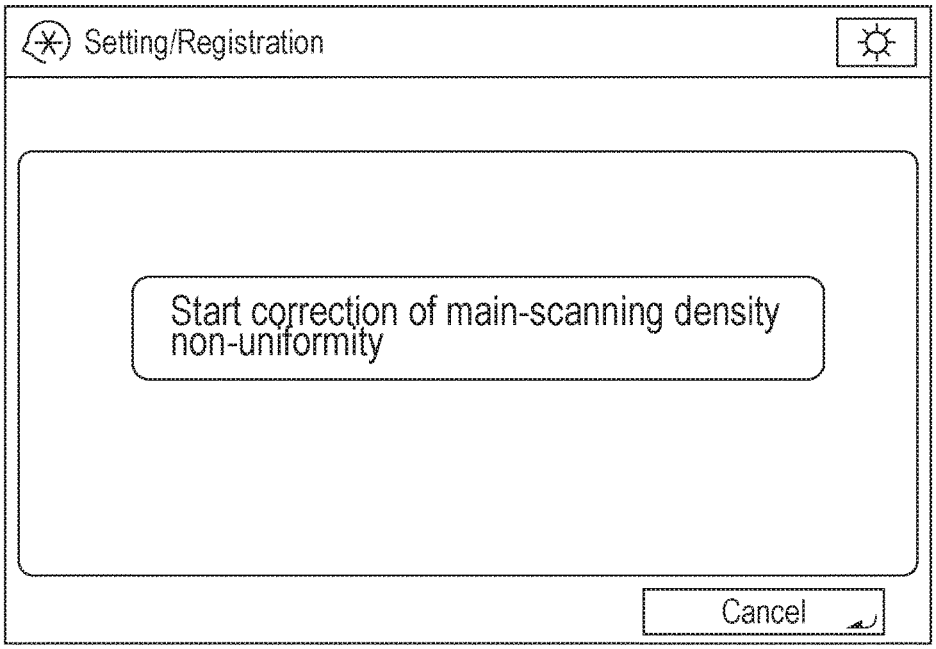
FIG. 5 is a diagram illustrating a screen for starting correction of main-scanning density non-uniformity, which is displayed on a display unit, according to one embodiment.
Figure 6A:
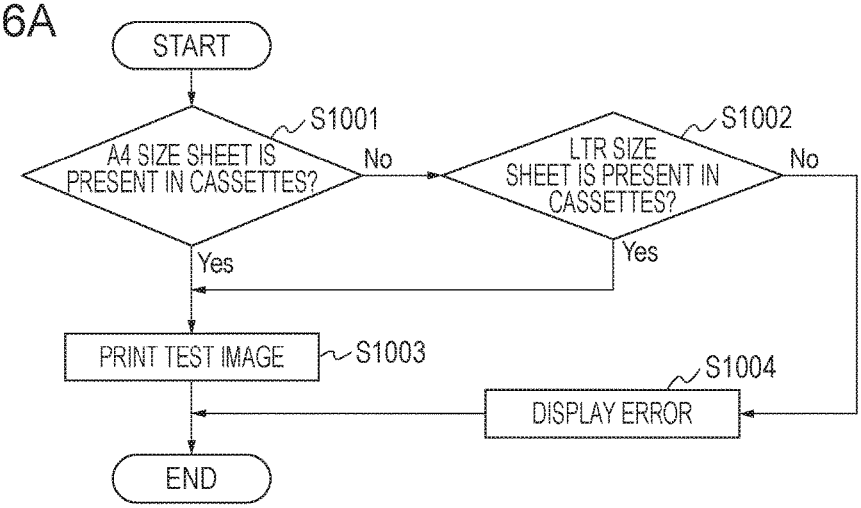
FIGS. 6A and 6B are flows for correcting density non-uniformity in the rotation axis direction of the photoconductor drums according to one embodiment.
Figure 7A:
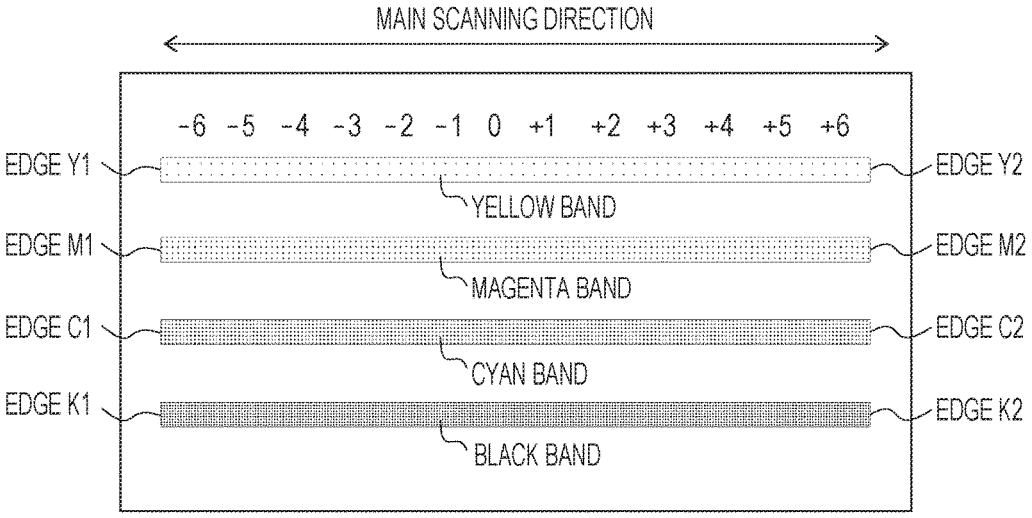
FIGS. 7A and 7B are diagrams illustrating test images.

A method of correcting density non-uniformity in the main scanning direction, which is a characteristic of the present embodiment, will be described. A user operates a display unit 206 of the copier 201, whereby a screen for starting correction of density non-uniformity in the main scanning direction, which is illustrated in FIG. 5, is displayed on the display unit 206. When the user presses a button for starting correction of main-scanning density non-uniformity, the process illustrated in FIG. 6A is started. FIG. 6A illustrates a flowchart performed by the control unit 205*a* when a test image for correcting density non-uniformity in the main scanning direction according to the present embodiment is formed. According to the flowchart, the method of correcting the density non-uniformity will be described. In step S1001 (hereinafter designated simply as S1001 or the like), it is determined whether or not an A4-size sheet is set in one of the paper cassettes C1 to C3. If an A4 size sheet is present in one of the cassettes, a test image illustrated in FIG. 7A is printed (S1003). As illustrated in FIG. 7A, the band for each color is printed in the main scanning direction in the test image. The numbers from −6 to +6 in the test image indicate addresses serving as positions in the main scanning direction. The entire band for each color is formed under the same condition. Herein, the condition means image density and the laser beam amount. When density non-uniformity occurs in the main scanning direction, non-uniformity occurs in density of a band. As described below, in the present embodiment, density is corrected so that the density of a toner image to be formed becomes uniform at the addresses.

Figure 7B:
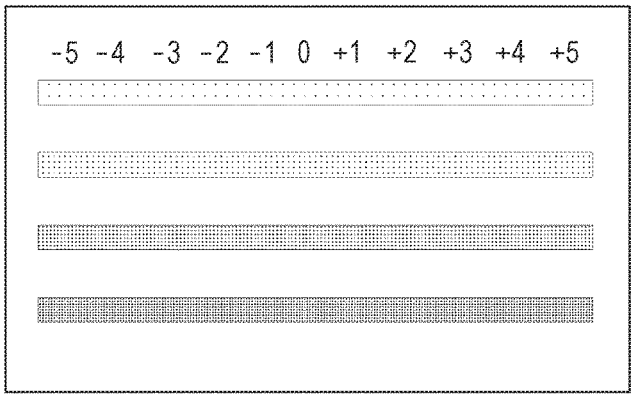

Returning back to the flowchart in FIG. 6A, description will be continued. If an A4 size sheet is not present in any of the cassettes, the control unit 205*a* determines whether or not an LTR size sheet is set in one of the cassettes (S1002). If an LTR size sheet is set in one of the cassettes, a test image illustrated in FIG. 7B is printed (S1003). The reason why an A4 size sheet is preferentially selected to print a test image is as follows. The width of A4 size in the main scanning direction is about 297 mm. In contrast, the width of LTR size in the main scanning direction is about 279 mm. Therefore, the size of a photoconductor drum 212 in the main scanning direction is designed so that an image of A4 size which has a wider width may be formed. Consequently, as illustrated in FIG. 7B, when a test image is printed on an LTR size sheet, portions of the test image which correspond to the addresses +6 and −6 are not formed. For the portions of the test image which are not formed, it is not possible to correct density directly on the basis of the image printed on the sheet. Formation of a test image on a sheet having a wider width in the main scanning direction produces a wider range in which density is directly corrected. Therefore, in the present embodiment, an A4 size sheet is preferentially selected to form the test image.

If an A4 size sheet and an LTR size sheet are not set in the cassettes, an error is displayed and the process ends (S1004).

As described above, when an image other than a test image is to be printed, the writing position of a laser in the main scanning direction is adjusted for each paper cassette. However, in the present embodiment, the adjustment is not performed when a test image is to be printed. This is because an operation without adjustment of the writing position in the main scanning direction in printing of a test image allows density non-uniformity in the main scanning direction to be corrected with high accuracy.

More detailed description will be made. As illustrated in FIG. 7A, the band for each color is formed in a test image. Edges are provided at the ends of the band for each color. For example, for a yellow band, an edge Y1 and an edge Y2 are provided. The midpoint between the edge Y1 and the edge Y2 is aligned with the center of the photoconductor drum 211Y in the main scanning direction, and density non-uniformity in the main scanning direction is corrected. For the bands for magenta, cyan, and black, a similar method is used to align the midpoint of the band for each color with the center of the photoconductor drum for the color. This method allows density non-uniformity in the main scanning direction to be corrected without an influence of the position of a sheet for each paper cassette. Conversely, when the writing position in the main scanning direction for each paper cassette is adjusted, the midpoint between the edge Y1 and the edge Y2 is misaligned with respect to the center of the photoconductor drum in the main scanning direction by the adjustment amount. Then, density is corrected at a position shifted from the original position at which correction is to be corrected, and it is not possible to correct the density non-uniformity accurately. As described above, in printing of a test image, the writing position in the main scanning direction for each paper cassette is not adjusted, whereby the position of a photoconductor drum in the main scanning direction may match that of the test image with high accuracy.

Figures 8A, 8B, 8C:
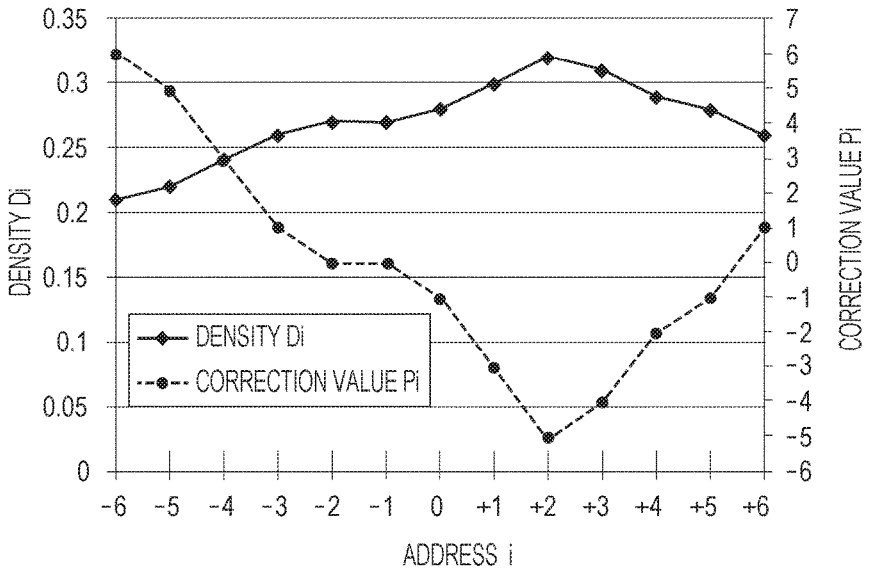
FIGS. 8A to 8C are a graph and tables illustrating detection results of a test image and correction values corresponding to the detection results according to one embodiment.

A method of correcting density non-uniformity in the main scanning direction by using a test image formed on a sheet will be described. When the flowchart illustrated in FIG. 6A is used to print a test image on a sheet, a screen for requesting reading of the test image using a reader is displayed on the display unit 206 (S1005 in FIG. 6B). According to the request, the user sets the test image on a reader 201, and the reader 201 reads the test image, whereby density information for each color at the positions in the main scanning direction is obtained. The obtained density information is stored in a RAM 205*c* (see FIG. 3) provided for the main-body circuit substrate which is a control unit. The solid-line graph in FIG. 8A is exemplary obtained density data. The horizontal axis in FIG. 8A indicates the positions in the main scanning direction which are designated as addresses. The addresses in FIG. 8A correspond to the addresses in a test image (see FIG. 7A). The vertical axis on the left indicates the density of the image at a corresponding address.

Upon completion of reading, the control unit 205*a* (see FIG. 1B) included in the main-body circuit substrate 205 performs error determination as to whether or not an abnormal value is present in the density values obtained through reading (S1007). Herein, an abnormal value indicates a case in which, for example, an extreme change is present between density values at adjacent addresses. This case is presumed to occur when formation and reading of the test image are not normally completed. If density is corrected on the basis of an abnormal value, instead of improving image quality, image quality may be reduced. Therefore, when occurrence of an error is determined, reading results obtained last time are used to determine correction values, and data is set (S1012).

If no errors occur, the control unit 205*a* which serves as a correction data generating unit performs the calculation described below, and determines correction values P(i). The correction values P(i) are determined so that density non-uniformity between addresses is corrected. Specifically, the control unit 205*a* refers to density data at each address which is stored in the RAM 205*c*, and specifies an address at which the lowest density value is obtained. Then, how much the density values at the other addresses are to be corrected is determined so that the corrected density agrees with the density at the address at which the lowest density is obtained. The correction value P(i) at each address is calculated by using the following expression.

$$P(i)=\{D\text{min}-D(i)\}\times\alpha \quad \text{(Math. 1)}$$

In Math 1, Dmin represents a density value at the address at which the lowest density is obtained. In the example in FIG. 8B, the density value at the address −6 is the lowest, and Dmin=0.21. D(i) represents density at an address i. For example, in FIG. 8B, D(+3)=0.31 at the address +3. The symbol α represents a coefficient for converting a density difference into a correction value. Exemplary correction values P(i) thus obtained are illustrated as a broken-line graph in FIG. 8A. As a correction value P(i) has a larger value, the laser beam amount at the address is set larger. As is clear from the graph in FIG. 8A, in the present embodiment, the laser beam amount is set larger for a portion in which a lower density is obtained in the main scanning direction. In contrast, the laser beam amount is set smaller for a portion in which a higher density is obtained. Thus, by adjusting the laser beam amount, the density of a toner image may be made uniform in the main scanning direction.

Figure 9:
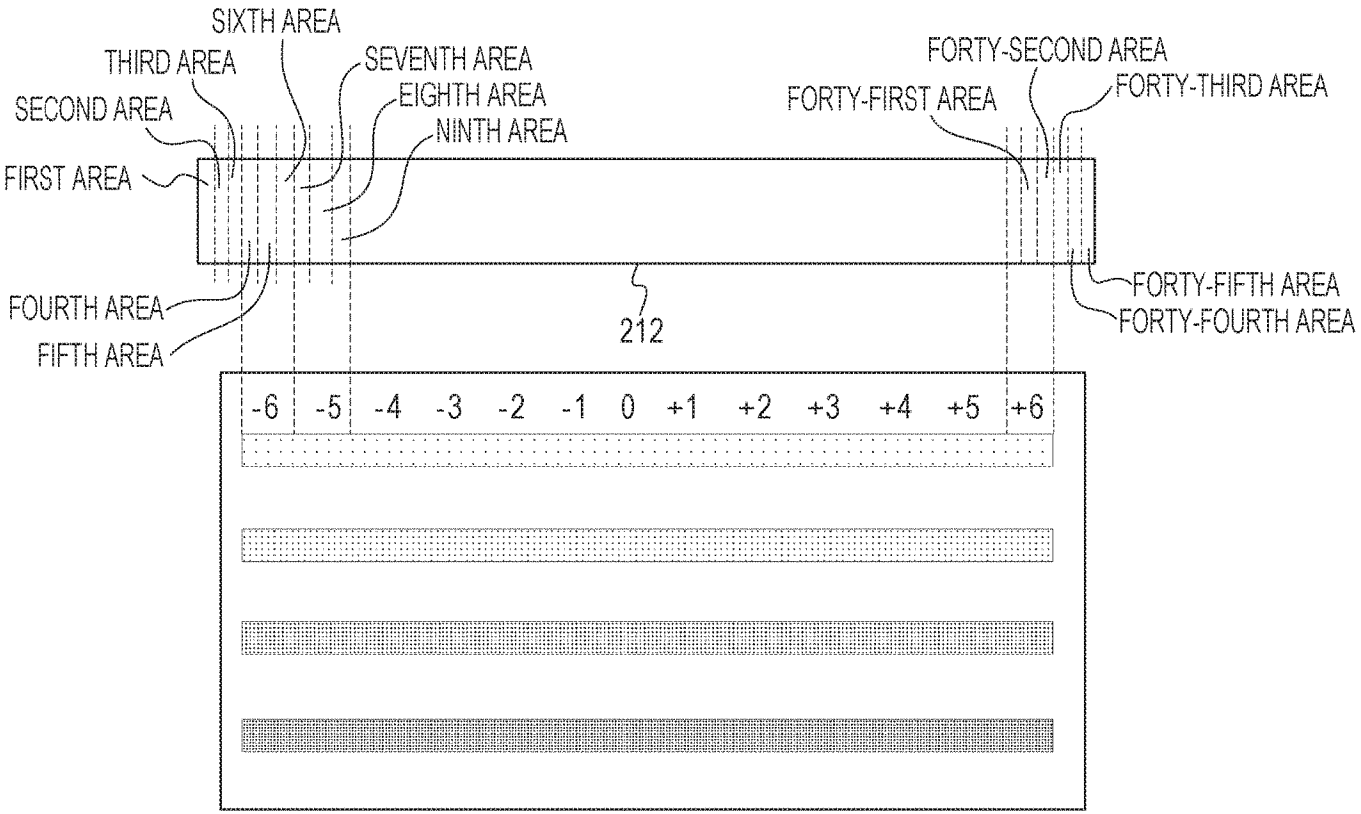
FIG. 9 is a diagram illustrating the positional relationship between a test image and a photoconductor drum in the rotation axis direction of the photoconductor drum according to one embodiment.

Control of the laser beam amount for making the density of a toner image uniform will be described. To control the light amount for exposure depending on a position in the main scanning direction, control areas are assigned to the surface of a photoconductor drum 212 in the main scanning direction. FIG. 9 is a diagram illustrating control areas assigned on the drum surface. In the present embodiment, the surface of the photoconductor drum 212 is equally divided into small areas, the first area to the forty-fifth area. Further, FIG. 9 illustrates the relationship between the address of a test image and the control area on the photoconductor drum. In the present embodiment, a correction value at the address −6 is applied to the fourth area to the sixth area. Similarly, a correction value at the address −5 is applied to the seventh area to the ninth area. Thus, the correction value P(i) at each address is set to the correction value at each of the corresponding control areas.

Returning back to FIG. 3, a control method of changing the light amount by using correction values will be described. The correction value at each address and that for each control area are stored in the RAM 205*c*. The control unit 205*a* inputs the correction value for each control area to the voltage setting unit 78. The voltage setting unit 78 changes the VLD value during one scanning period by using, as a reference, the voltage determined in the APC described above. VLD is changed in one scanning period on the basis of the correction value for each control area. When the voltage setting unit 78 changes VLD, ILD also changes. When ILD changes, the light amount with which the LD 72 emits light in one scanning period changes, and the density of the toner image is corrected. That is, the voltage setting unit 78 which serves as a correcting unit uses correction values to correct density in one scanning period. FIG. 4 illustrates how correction values are used to correct the laser beam amount in one scanning period. Data_ 1 to Data_45 represent correction values for the control areas.

As illustrated in FIG. 9, the area of the fourth area to the forty-second area corresponds to the toner image band. Thus, the correction data which is directly obtained from results obtained through reading of a toner image formed on a test image is used as first correction data.

In contrast, the area of the first area to the third area and the area of the forty-third area to the forty-fifth area do not correspond to the toner image. This is because the size of a photoconductor drum in the main scanning direction is designed so as to be larger than the maximum size of a sheet on which an image is formed. The reason is that, as described above, the case in which the position of a sheet reaching the transfer unit varies in the main scanning direction is to be addressed.

Therefore, in the present embodiment, in correction of the light amount in the first area to the third area, the correction value for the fourth area which is an adjacent area is used as correction data. Similarly, in correction of the light amount in the forty-third area to the forty-fifth area, the correction value for the forty-second area which is an adjacent area is used as correction data. Thus, density correction data corresponding to the areas outside the area in which a toner image of a test image is formed is used as second correction data. The range on the photoconductor drum 212 which corresponds to the second correction data differs between when the test image is formed on an A4 size sheet and when the test image is formed on an LTR size sheet. That is, formation of a test image on an LTR size sheet produces a wider range corresponding to the second correction data.

An advantage that the second correction data is determined on the basis of the first correction data will be described. Density non-uniformity in the main scanning direction occurs, for example, due to variations in light sensitivity of a photoconductor drum. Therefore, smooth non-uniformity like waves often occurs. The light amount is corrected by using, as the second correction data, the first correction data for an adjacent control area, whereby an effect that the density non-uniformity is reduced is expected compared with the case in which the light amount is not corrected at all.

In consideration that the density non-uniformity is smooth non-uniformity like waves, the amount of change in correction value between control areas may be set small. For example, the correction value at the address −6 is applied only to the fifth area, and the correction value at the address −5 is applied only to the eighth area. For the other control areas (the first to fourth areas, the sixth to seventh areas, and the like), a correction value may be determined by using an approximate expression (linear approximation or polynomial approximation) on the basis of the correction value for the fifth area and the correction value for the eighth area.

In the present embodiment, the density non-uniformity is corrected by changing the light amount with which a photoconductor drum is exposed. However, this is not limiting. For example, the first correction data and the second correction data may be used to adjust density of to-be-printed image data in the main scanning direction. When correction data is used to adjust density of image data, the control unit 205*a* serves as a correcting unit.

Figure 6B:
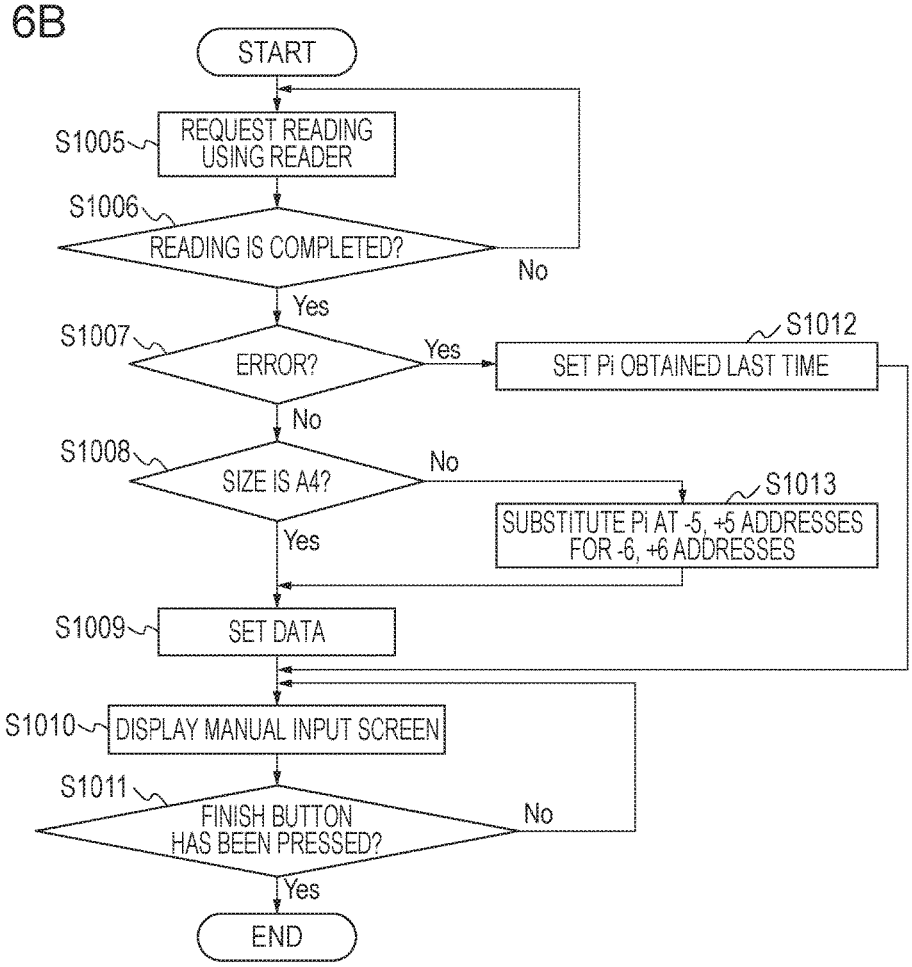

Returning back to the flowchart in FIG. 6B, description will be continued. In S1008, it is determined whether or not the test image which has been read is A4-sized. If it is not A4-sized, the test image is LTR-sized (see S1001 and S1002 in FIG. 5A). At that time, as illustrated in FIG. 8C, the correction value at the address +5 is substituted for the correction value at the address +6. The correction value at the address −5 is substituted for the correction value at the address −6 (S1013). That is, the correction data at the address +6 and the address −6 which is the second correction data is determined on the basis of the correction values at the address +5 and the address −5 which are the first correction data. The reason why such a process is performed is as follows.

In the case of A4 size, values P(i) corresponding to the address +6 to the address −6 are calculated. In contrast, in the case of LTR size, values P(i) corresponding to the address +5 to the address −5 are calculated. That is, in the case of LTR size, correction values at the address +6 and the address −6 are not calculated. This is because, as described above, when a test image is formed on an LTR size sheet, a test image is not printed in portions corresponding to the address +6 and the address −6. Therefore, when correction values are calculated by using a test image of LTR size, the correction values at the address +6 and the address −6 are a space (that is, no correction). Accordingly, the density non-uniformity between the address +5 and the address +6 may be conspicuous. As described above, the density non-uniformity is often distributed smoothly like waves. Therefore, on the basis of the correction data for the range in which a test image is printed, correction data for the outside areas is estimated and used, whereby an effect that the non-uniformity becomes inconspicuous is expected.

Further, a burden on a user may be alleviated in display of a manual input screen. In the present embodiment, as illustrated in FIG. 6B), a mode is provided in which, after data is set in S1009, the user checks the data which has been set and manually modifies the data (S1010). This enables a user who does not satisfy the automatic density non-uniformity correction in S1005 to S1009 to input correction values manually. In the manual input mode, an input screen illustrated in FIG. 10 is displayed on the display unit 206. In the input screen in FIG. 10, correction values for the colors for the positions in the main scanning direction are displayed under the display of Y, M, C, and K in such a manner as to be capable of being changed. That is, the user may manually change the displayed correction values. In the manual input mode, when the process in S1013 is not performed, the set values at the address +6 and the address −6 are a space, and the user hesitates about deciding which value is to be set. The process as in S1013 is performed, whereby values which serve as a guideline for the correction values at the address +6 and the address −6 are already input, causing a burden on a user to be alleviated.

After the manual input screen is displayed, when the user presses a finish button, the correction process is completed (S1011).

In the present embodiment, after correction values are automatically set (S1009), the manual input screen is displayed (S1010), whereby the user is given an opportunity in which the correction values are checked and modified. When the user himself/herself does not want to check and modify the correction values, the process may be ended without displaying the manual input screen and the finish button after S1009.

As the size of a sheet on which a test image is formed, Δ4 and LTR are described as typical examples. However, this is not limiting. For example, in the case where the maximum size in the main scanning direction which is supported by the copier is LTRR (the length in the main scanning direction is 216 mm), a test image of LTRR is preferentially formed and the density non-uniformity is corrected. In this case, LTRR size is substituted with A4 size in S1001 and S1008, and, for example, A4R size (the length in the main scanning direction is 210 mm) is substituted with LTR size in S1002. At that time, similarly, the correction value P(i) at an adjacent address is substituted for the values at addresses corresponding to a portion in which the test image is not formed when printing is performed on an A4R size sheet in S1013.

In the present embodiment, the non-uniformity is corrected through density measurement at 13 positions from the address +6 to the address −6. The number of positions at which density is measured may be increased or decreased in accordance with the condition of the density non-uniformity which occurs or the size in the main scanning direction.

In the present embodiment, correction data at the addresses displayed on a test image is displayed on the display unit. A mode in which correction data for each control area is displayed may be provided. Since there are many control areas, it is not suitable for a user operation. However, it is useful, for example, when a serviceman performs display and fine adjustment. In this case, even when the size of a sheet is A4, the first correction data and the second correction data (correction values for the first to third areas and the forty-second to forty-fifth areas) are displayed.

An image forming apparatus which corrects density also in areas outside of the range in which a test image is formed may be provided.

While exemplary embodiments have been described, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2015/083530, filed Nov. 30, 2015, which is hereby incorporated by reference herein in its entirety.

What is claimed is:

1. An image forming apparatus comprising:

a photoconductor that rotates;

an exposure unit configured to expose the photoconductor to light and to form an electrostatic latent image on the photoconductor;

a developing unit configured to develops the electrostatic latent image by using toner, the electrostatic latent image being formed on the photoconductor;

a transfer unit configured to transfers a toner image onto a sheet, the toner image being obtained by the developing unit performing development onto a surface of the photoconductor;

a document reader configured to read an image on a document;

a data generating unit configured to generate first correction data and second correction data on the basis of a reading result, the reading result being obtained by the document reader reading a test image formed on a sheet, the first correction data being data for a first correction of image density in a rotation axis direction of the photoconductor, the first correction being performed in each of a plurality of areas of the photoconductor, the plurality of areas corresponding to an area in which the toner image of the test image is formed, the second correction data being data for a second correction of image density in the rotation axis direction of the photoconductor, the second correction being performed in an outside area outside the area in which the toner image of the test image is formed; and a display unit configured to, when the test image which is read by the document reader is formed on a sheet of first size, displays the first correction data in such a manner that the first correction data is capable of being changed, and, when the test image which is read by the document reader is formed on a sheet of second size, the second size being smaller than the first size in dimension in the rotation axis direction of the photoconductor, displays the first correction data and the second correction data in such a manner that the first correction data and the second correction data are capable of being changed.

2. The image forming apparatus according to claim 1, wherein the exposure unit uses the first correction data and the second correction data to correct a light amount with which the photoconductor is exposed in the rotation axis direction of the photoconductor.

3. The image forming apparatus according to claim 1, wherein the correcting unit uses the first correction data and the second correction data to correct density of image data, the image data being to be printed.

4. The image forming apparatus according to claim 1, wherein the exposure unit includes a semiconductor laser that emits a light beam, and a deflector that deflects the light beam in such a manner that the light beam emitted from the semiconductor laser scans the surface of the photoconductor.

5. The image forming apparatus according to claim 1, wherein the exposure unit includes a plurality of LED chips that are arranged in the rotation axis direction of the photoconductor in order to expose the photoconductor to light.

6. An image forming apparatus comprising:

an image forming unit comprising:

a photoconductor that rotates, an exposure unit configured to expose the photoconductor to light and to form an electrostatic latent image on the photoconductor, a developing unit configured to develop the electrostatic latent image by using toner, the electrostatic latent image being formed on the photoconductor, a transfer unit configured to transfer a toner image onto a sheet, the toner image being obtained by the developing unit performing development onto a surface of the photoconductor, wherein an exposure amount of the photoconductor by the exposure unit is controlled based on correction data corresponding to each of a plurality of areas on the photoconductor in a rotation axis direction of the photoconductor, and wherein the image forming unit is configured to form a test pattern on a sheet;

a display on which a user performs input, wherein the display displays a correction amount based on the correction data in association with each of the plurality of areas in the rotation axis direction of the photoconductor, and display of the correction amount is changeable by the input of the user;

a document reader configured to read an image formed on a document; and a controller configured to generate the correction data for each of areas on which the test pattern is formed on the basis of a reading result of the test pattern by the document reader, wherein in a case where the controller is unable to generate, from the reading result, the correction data for an area positioned at an end in the rotation axis direction among the plurality of areas, the display displays a correction amount based on correction data to be generated from the reading result for an area adjacent to the area positioned at the end in association with the area positioned at the end.

7. The image forming apparatus according to claim 6, wherein the controller determines whether the controller is able to generate, from the reading result, the correction data for the area positioned at the end, according to a size of a sheet on which the test pattern is to be formed.

8. The image forming apparatus according to claim 6, wherein the controller determines that the controller is able to generate, from the reading result, the correction data for the area positioned at the end, in a case where the test pattern is to be formed on an A4-size sheet, and the controller determines that the controller is not able to generate, from the reading result, the correction data for the area positioned at the end, in a case where the test pattern is to be formed on an LTR-size sheet.

9. The image forming apparatus according to claim 6, wherein the exposure unit includes a semiconductor laser that emits a light beam, and a deflector that deflects the light beam in such a manner that the light beam emitted from the semiconductor laser scans the surface of the photoconductor.

10. The image forming apparatus according to claim 6, wherein the exposure unit includes a plurality of LED chips that are arranged in the rotation axis direction of the photoconductor in order to expose the photoconductor to light.

11. The image forming apparatus according to claim 6, wherein the test pattern is a band-like image extending in the rotation axis direction.

12. The image forming apparatus according to claim 6, wherein the image forming unit includes a plurality of photoconductors for forming yellow, magenta, cyan, and black toner images, respectively, and the image forming unit forms the test pattern separately for yellow, magenta, cyan, and black.

13. The image forming apparatus according to claim 12, wherein the image forming unit forms yellow, magenta, cyan, and black test patterns on one sheet.

* * * * *